US009508326B1

(12) United States Patent
Mondell

(10) Patent No.: US 9,508,326 B1
(45) Date of Patent: Nov. 29, 2016

(54) UNITARY GUITAR NECK, PICKUP AND BRIDGE MOUNTING SYSTEM

(71) Applicant: Robert T. Mondell, Forked River, NJ (US)

(72) Inventor: Robert T. Mondell, Forked River, NJ (US)

( * ) Notice: Subject to any disclaimer, the term of this patent is extended or adjusted under 35 U.S.C. 154(b) by 0 days.

(21) Appl. No.: 15/176,195

(22) Filed: Jun. 8, 2016

Related U.S. Application Data

(60) Provisional application No. 62/276,095, filed on Jan. 7, 2016.

(51) Int. Cl.

| | |
|---|---|
| ***G10D 3/06*** | (2006.01) |
| ***G10D 1/08*** | (2006.01) |
| ***G10H 3/18*** | (2006.01) |
| ***G10D 3/04*** | (2006.01) |

(52) U.S. Cl.
CPC ..... *G10D 1/085* (2013.01); *G10D 3/04* (2013.01); *G10D 3/06* (2013.01); *G10H 3/181* (2013.01); *G10H 3/182* (2013.01)

(58) Field of Classification Search
CPC ..... G10D 1/085; G10D 3/04; G10D 3/06
See application file for complete search history.

(56) References Cited

U.S. PATENT DOCUMENTS

| | | | | | |
|---|---|---|---|---|---|
| 3,396,621 | A * | 8/1968 | Dycus | G10D 1/085 | 84/267 |
| 3,657,462 | A * | 4/1972 | Robinson | G10D 1/08 | 84/267 |
| 4,121,492 | A * | 10/1978 | Berardi | G10D 3/06 | 84/293 |
| 4,188,850 | A * | 2/1980 | Kaman, II | G10D 1/085 | 84/291 |
| 4,538,497 | A * | 9/1985 | Smith | G10D 1/085 | 84/291 |
| 4,829,870 | A * | 5/1989 | Ralston | G10D 1/085 | 84/291 |
| 5,929,362 | A * | 7/1999 | Oteyza | G10D 1/085 | 84/293 |
| 6,791,022 | B2 * | 9/2004 | Green | G10D 1/085 | 84/290 |
| 7,002,065 | B2 * | 2/2006 | Petersen | G10D 1/085 | 84/290 |
| 9,378,711 | B1 * | 6/2016 | Stadnyk | G10D 1/085 | |
| 2003/0164080 | A1 * | 9/2003 | Childress | G10D 1/00 | 84/291 |

* cited by examiner

*Primary Examiner* — Robert W Horn
(74) *Attorney, Agent, or Firm* — Michael R. Philips

(57) ABSTRACT

The system for mounting a guitar neck, pickup, and bridge provides a plate having a number of wings formed in pairs. The guitar body is formed with a cavity and the plate is assembled to a lower surface of the body in the cavity, the wings extending laterally beyond the cavity. The guitar neck is mounted to an extended portion of the plate. A bridge and at least one audio pickup are mounted on the plate within the cavity, the bridge supporting the guitar strings above the audio pickup.

6 Claims, 3 Drawing Sheets

UNITARY GUITAR NECK, PICKUP AND BRIDGE MOUNTING SYSTEM

FIELD OF THE INVENTION

The present invention relates to the field of guitar construction, and more particularly to a system for mounting a guitar neck, pickup, and bridge.

BACKGROUND OF THE INVENTION

A guitar is classified either as an acoustic variety or an electric variety. The invention disclosed below pertains primarily to the electric variety guitar. Electric guitars are formed with a substantially solid body block to which the neck is affixed, generally by an adhesive as well as screw fasteners. Electric guitars utilize one or more microphones, also known as pickups, that are mounted in the vicinity of the strings to capture the sound vibrations that are generated by strumming or plucking the strings. The pickups generate an electrical signal that is transmitted to an amplifier and the amplified signal is transmitted to a series of speakers.

In presently known electric guitars, the pickups are embedded in the solid wood body of the guitar. Solid wood tends to be a partial sound sink, i.e. the guitar body absorbs sound rather than reflecting or transmitting the sound, resulting in a somewhat muffled effect. While this subdued sound characteristic can be partially overcome with electronic manipulation and amplification, the invention disclosed herein is based on a discovery that by mounting the pickups to a metallic plate, natural resonance and tone clarity are enhanced and an improved and distinctive sound quality is achieved.

SUMMARY OF THE INVENTION

The system of the invention consists of mounting a metallic plate to the guitar body and assembling the neck to the metallic plate, resulting in a stable and strong connection. A cavity is formed in the guitar body over the metallic plate. The bridge is mounted to the plate to isolate the strings from the wood, and the pickups are mounted to the plate beneath the strings. The invention described below utilizes these newly discovered principles to produce a more durable guitar with an enhanced sound quality.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figure 1:
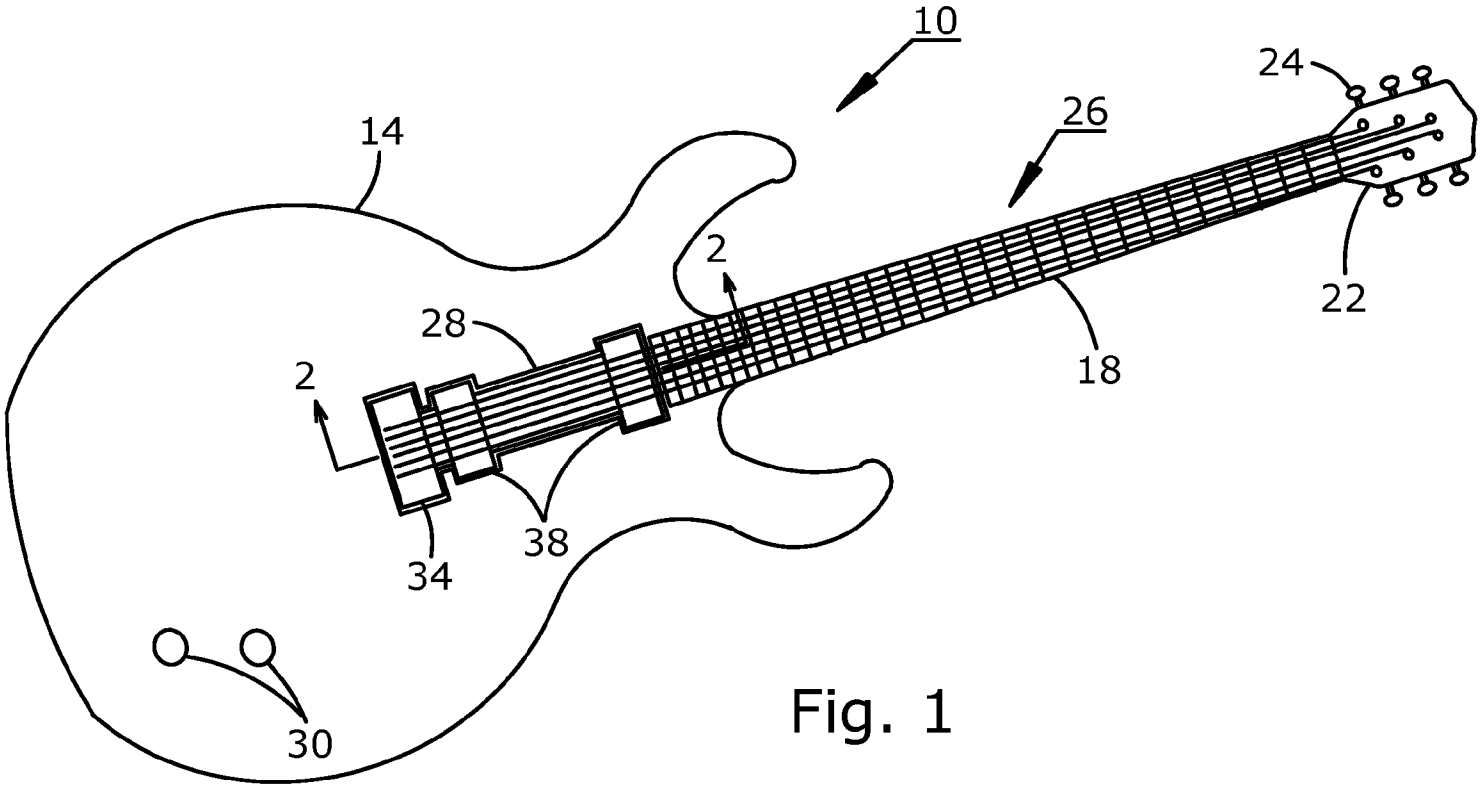
FIG. 1 is a top plan view of a guitar assembled according to the mounting system of the present invention.

Referring to FIG. 1, a guitar 10 is shown in top plan view. Guitar 10 has a body 14 to which a neck 18 is mounted as will be described below. Neck 18 terminates with a head 22 having a series of tuning keys 24 assembled thereto. A cavity 28 is formed through body 14, cavity 28 being configured to accommodate a bridge 34 and two audio pickups 38. A plurality of strings 26 are connected at a first end to bridge 34 and at a second end to tuning keys 24 of head 22. One or more control knobs 30 are mounted to body 14, control knobs 30 being electrically connected in a manner to modulate the pitch and amplitude of the sound signals transmitted from pickups 38 to an amplifier and speaker system (not shown).

Figure 2:
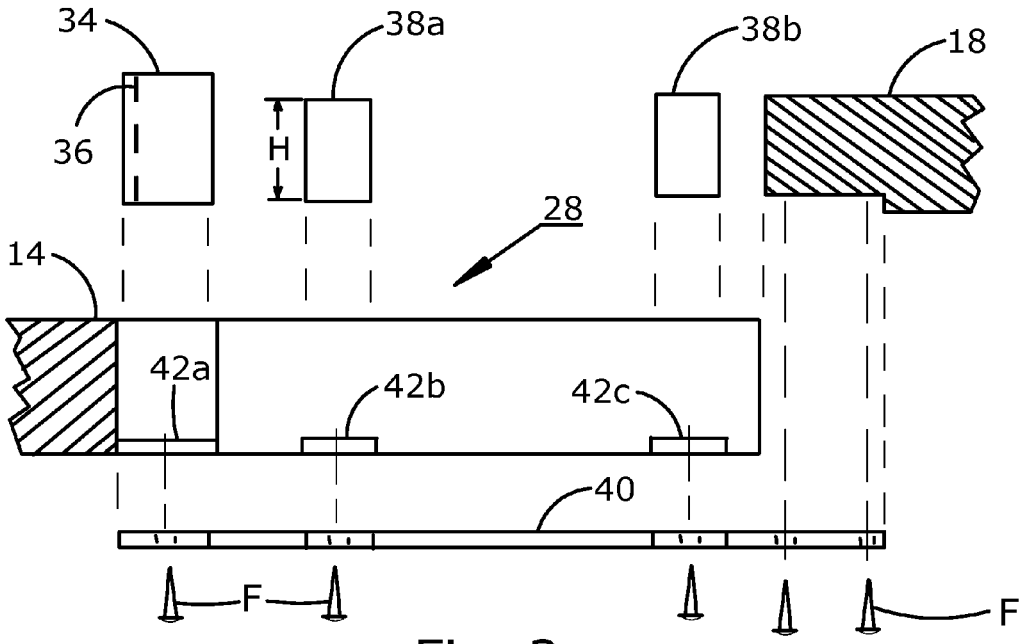
FIG. 2 is an exploded cross-sectional view of a portion of the guitar body and guitar neck taken in the direction indicated by line 2-2 of FIG. 1 with the mounting device, the bridge, and the pickups in position for assembly.

Referring now to FIG. 2, a portion of guitar body 14 including cavity 28 and neck 18, is shown as indicated by line 2-2 of FIG. 1 in exploded partial cross-sectional view. The drawing also shows bridge 34 and pickups 38*a*, 38*b* positioned above cavity 28. In addition, a mounting plate 40 is shown in position below cavity 28 and the connecting end of neck 18. Plate 40 is located for being mounted to body 14, and neck 18 to be mounted to plate 40, resulting in the upper surface of neck 18 residing in substantially coplanar alignment with the upper surface of body 14. Bridge 34 and pickups 38*a*, 38*b* are passed down through cavity 28 for being mounted to plate 40 by any conventional fastening means. A series of fasteners F, e.g. screws, are positioned for insertion to assemble plate 40 to body 14 and to assemble neck 18, bridge 34 and pickups 38*a*, 38*b* to plate 40. As illustrated, pickups 38*a*, 38*b* are smaller in height dimension H than bridge 34 to allow strings 26 (see FIG. 1) to pass over pickups 38*a*, 38*b* without physical contact. A series of channels 36 are formed through bridge 34 to anchor the strings.

Figure 3:
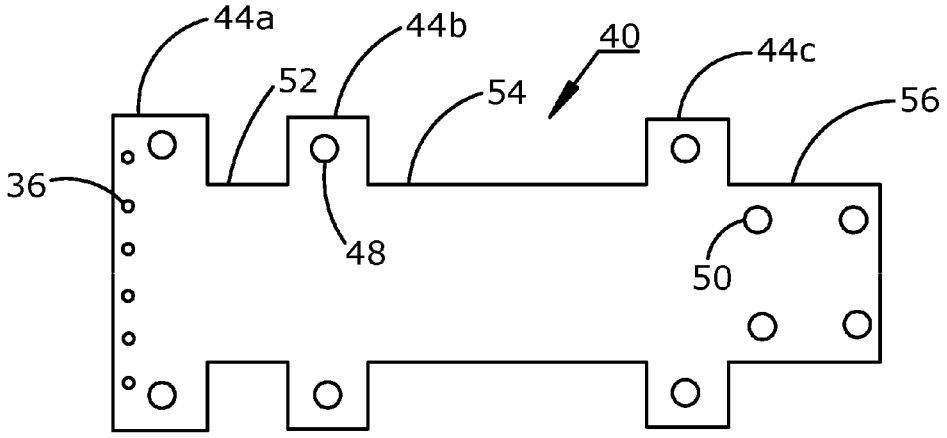
FIG. 3 is a top plan view of a mounting device or plate according to the present invention.

Referring now to FIG. 3 with further reference to FIG. 2, mounting plate 40 is shown in top plan view. The elevation plan configuration of cavity 28 (see FIG. 1) is understood to follow the shape of metallic plate 40. Plate 40 is formed with a series of laterally extending wings 44*a*, 44*b*, and 44*c*. As illustrated, there are two of each of wings 44*a*, 44*b*, and 44*c*, only one of each being labeled. A series of dadoes 42*a*, 42*b*, and 42*c* are formed into body 14 on either side of cavity 28 to accommodate wings 44*a*, 44*b*, and 44*c*, enabling plate 40 to be mounted flush with the lower surface of body 14. Wings 44*a*, 44*b*, and 44*c* are formed with mounting holes 48 for connection to body 14, neck 18, bridge 34, and pickups 38*a*, 38*b*. Bridge 34 is to be mounted on plate 40 between wings 44*a*. Pickup 38*a* is to be mounted on plate 40 between wings 44*b*. Pickup 38*b* is to be mounted on plate 40 between wings 44*c*. A neck support portion 56 is provided at the end of plate 40 with a series of neck mounting screw holes 50 formed therethrough. Mounting plate 40 is connected to body 14 by fasteners F, e.g. screws, through holes 48. Neck 18 is connected to neck support portion 56 of mounting plate 40 by additional fasteners F. It will be understood that the principles of the invention may be practiced with a plate of a different shape, including a simple rectangle.

Figure 4:
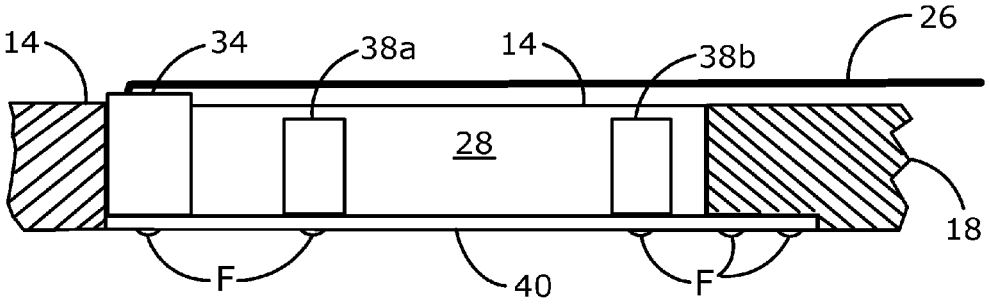
FIG. 4 is a view of the components shown in FIG. 2 after being assembled.

Referring now to FIG. 4, the portion of the guitar shown in FIG. 2 is now depicted in assembled cross-sectional view. Mounting plate 40 is connected by means of fasteners F to body 14, with cavity 28 seen as a hollow central section. Neck 18 is mounted to plate 40 with additional fasteners F. Bridge 34 and pickups 38*a*, 38*b* are mounted to plate 40 by an adhesive or further fasteners. As noted above, bridge 34 is taller than pickups 38*a*, 38*b* to position strings 26 higher than the upper surface of neck 18 and higher than pickups

38*a*, 38*b*. As seen here, pickups 38*a*, 38*b* are located beneath strings 26 in a position to receive vibrations therefrom. Pickups 38*a*, 38*b* transmit signals corresponding to the string vibrations to an amplifier, with tonal embellishment added by metallic plate 40.

Mounting plate 40 is preferably formed of metal, e.g. steel or aluminum. It has been discovered that providing a metallic component, particularly a component in connection with the guitar pickups, enhances the sound characteristic of the guitar. A specific enhancement involves added mid-range resonance and highlighting the frequencies that the wooden body and neck are responsive to. In addition, the tonal clarity of the instrument is improved with greater articulation. The natural harmonics are able to project rather than be absorbed into the softer wood portions of the guitar. Different sound quality is produced by using a different type metal, different plate dimensions, as well as different woods. Regardless of the type metal used for the plate, the presence of the metal component in an electric guitar provides added electronic shielding against a stray current, keeping the sound as clean as possible.

While the description above discloses a preferred embodiment of the present invention, it is contemplated that numerous modifications of the invention are possible and are considered to be within the scope of the claims that follow.

What is claimed is:

1. A unitary guitar neck, pickup, and bridge mounting system, comprising:

a. a guitar body formed with a cavity therethrough;

b. a plate configured for being mounted to a lower surface of the guitar body in a position spanning the cavity;

c. the plate formed with a neck support portion for mounting the guitar neck; and d. the cavity and the plate configured for mounting a bridge and at least one audio pickup.

2. The system described in claim 1, wherein the plate is formed with a plurality of extended wings for mounting the plate to the guitar body.

3. The system described in claim 2, further comprising a plurality of dadoes formed in the guitar body to accommodate the wings, permitting the plate to reside substantially flush with a lower surface of the guitar body.

4. The system described in claim 1, wherein the bridge is taller than the audio pickup when both are mounted in contact with the plate.

5. The system described in claim 1, wherein the plate is formed of metal.

6. The system described in claim 1, wherein the at least one audio pickup comprises two audio pickups.

* * * * *